US008118944B2

(12) United States Patent
Fay et al.

(10) Patent No.: US 8,118,944 B2
(45) Date of Patent: Feb. 21, 2012

(54) SELF-CLEANING PILL COUNTING DEVICE, AND CLEANING METHOD

(75) Inventors: Brent Fay, Chester (CA); Michael Jarvis, Chester (CA)

(73) Assignee: Cleancount Incorporated, Chester (CA)

( * ) Notice: Subject to any disclaimer, the term of this patent is extended or adjusted under 35 U.S.C. 154(b) by 135 days.

(21) Appl. No.: 12/365,487

(22) Filed: Feb. 4, 2009

(65) Prior Publication Data

US 2010/0192979 A1 Aug. 5, 2010

Related U.S. Application Data

(63) Continuation of application No. PCT/CA2007/001760, filed on Oct. 2, 2007.

(60) Provisional application No. 60/848,375, filed on Oct. 2, 2006.

(51) Int. Cl.
*B08B 5/02* (2006.01)
*B08B 5/04* (2006.01)
*A61J 1/03* (2006.01)

(52) U.S. Cl. ..... 134/21; 222/148; 414/675; 134/37

(58) Field of Classification Search ..... 134/21; 53/169, 247; 222/148; 414/675; 15/345, 15/347

See application file for complete search history.

(56) References Cited

U.S. PATENT DOCUMENTS

| | | | | |
|---|---|---|---|---|
| 2,166,669 | A | 7/1939 | Farrell | |
| 2,530,009 | A | 11/1950 | Fields | |
| 3,738,485 | A | 6/1973 | Garland | |
| 3,848,395 | A | 11/1974 | Totten | |
| 4,063,645 | A | 12/1977 | Canterman et al. | |
| 4,065,000 | A | 12/1977 | Murton | |
| 4,396,828 | A | 8/1983 | Dino et al. | |
| 5,996,155 | A | 12/1999 | Chao et al. | |
| 6,004,400 | A | 12/1999 | Bishop et al. | |
| 6,425,212 | B1 | 7/2002 | Lovazzano | |
| 7,448,182 | B2 * | 11/2008 | Pearson | 53/247 |
| 2008/0105516 | A1 * | 5/2008 | Richwine | 198/771 |

FOREIGN PATENT DOCUMENTS

EP 0572140 1/1993

OTHER PUBLICATIONS

Fukazawa Hiroshi, Work Cleaning Device, an English abstract of JP 2006/159125, Jun. 22, 2006, Japan.

http://web.archive.org/web/20070715002559/http://www.nortonsandblasting.com/faq-dryiceblasting.html#q40, Norton Sandblasting Equipment, Jul. 15, 2007.

* cited by examiner

*Primary Examiner* — Michael Kornakov
*Assistant Examiner* — Natasha Campbell
(74) *Attorney, Agent, or Firm* — Bereskin & Parr LLP/S.E.N.C.R.L., s.r.l.

(57) ABSTRACT

A pills counting device is provided. It comprises a tray comprising a base member and a trough member. The device also comprises a lid member mounted on the base member and being movable between two extreme positions. The device also comprises at least one port provided in the tray and/or in the lid member and adapted to be connected in fluid communication with the base member and with an air intake of a vacuum device that can be remotely controlled. When a vacuum is applied to the at least one port, an air stream is established to entrain toward the vacuum device particles that may be present on surfaces of the device. A cleaning method using the aforesaid pills counting device is also disclosed.

26 Claims, 8 Drawing Sheets

SELF-CLEANING PILL COUNTING DEVICE, AND CLEANING METHOD

CROSS-REFERENCE TO RELATED APPLICATIONS

This application is a continuation of international patent application No. PCT/CA2007/001760 filed on Oct. 2, 2007, which claims the benefit of U.S. provisional application No. 60/848,375 filed on Oct. 2, 2006. These applications are hereby incorporated by reference in their entirety.

TECHNICAL FIELD OF INVENTION

The present invention relates to a self cleaning pill counting device to prevent contamination from one medication to another. The invention also relates to a method for cleaning said device.

BACKGROUND ART OF THE INVENTION

In hospital, nursing homes or pharmacies, batches of pills are counted on a pill tray. When different medications are counted on a same tray, the second or subsequent batch of pills could become contaminated with dust or heavier particles from the first batch, and so on. These contaminations could cause many inconveniences, such as, for example, allergic reactions in patients taking medication from the second or subsequent batch of pills.

Up to now, the only way to avoid contamination was to carefully wash the tray or to use a disposable tray. This is either time consuming and/or expensive.

Therefore, there is a strong need for a self cleaning pill counting device, and cleaning method thereof, that overcome the drawbacks of the prior art.

SUMMARY OF THE INVENTION

According to a preferred embodiment, the present invention relates to a self cleaning pill counting device comprising in combination:

- a tray comprising:
  - a base member having an upper surface for receiving a bulk quantity of pills;
  - a trough member alongside the base member and provided with a depression having opposite ends and at least one surface for receiving a load of a counted quantity of pills from said bulk quantity, one of said opposite ends further defining a spout for the unloading said counted quantity of pills in a pills container,
- a lid member having a lower surface, the lid member being mounted on the base member and being movable between two extreme positions, that is:
  - a first position where the lower surface of the lid member is away from the upper surface of the base member and the surface of the depression of the trough member;
  - a second position where the lower surface of the lid member is close and above the upper surface of the base member and the surface of the depression of the trough member to thereby creates a cavity;
- at least one port provided in the tray and/or in the lid member and adapted to be connected in fluid communication with the cavity and with an air intake of a vacuum device that is remotely controlled;

being understood that when the lid is in the second position and a vacuum is applied to at least one port, an air stream is established within the cavity to entrain toward the vacuum device dusts and/or particles that may be present is the cavity.

According to another preferred embodiment, the present invention relates to a device as described hereinabove, wherein the lower surface of the lid member is substantially mating above the upper surface of the base member and the surface of the depression of the trough member.

According to another preferred embodiment, the present invention relates to a device as described hereinabove, wherein the at least one port means one port is provided across the lid member and communicates with the cavity through the lower surface, or wherein the at least one port is provided across the base member and communicates with a chamber that is in fluid communication with cavity, the chamber being at least defined by a portion of the base member, and at least a portion of the lid member.

According to another preferred embodiment, the present invention relates to a device as described hereinabove, wherein when the at least one port is one opening provided across the lid member and communicates with the cavity through the lower surface, and at least a portion of the lower surface of the lid member defines a funnel of small height toward the opening.

According to another preferred embodiment, the present invention relates to a device as described hereinabove, wherein when the at least one port is provided across the lid member and communicates with the cavity through the lower surface:

- a periphery of the upper surface is adjacent a first wall member,
- at least a portion of a periphery of the lower surface is adjacent a second wall member, and
- the first wall member and the second wall member abut at least in part one against the other when the lid member is in the second position.

According to another preferred embodiment, the present invention relates to a device as described hereinabove, wherein when the at least one port is provided across the lid member and communicates with the cavity through the lower surface:

- the first wall member forms a first rim around the upper surface of the base member and a periphery of the depression,
- the second wall member forms a second rim around the lower surface of the lid member, and
- the first rim and the second rim abut at least in part one against the other when the lid member is in the second position.

According to another preferred embodiment, the present invention relates to a device as described hereinabove, wherein when the at least one port is one opening provided across the base and communicates with a chamber that is in fluid communication with said cavity, and the chamber is at least defined by a portion of the base member, and at least a portion of the lid member:

- a periphery of the upper surface is adjacent a first wall member,
- at least a portion of a periphery of the lower surface is adjacent a second wall member, and
- the first wall member and the second wall member abut at least in part one against the other when the lid member is in the second position.

According to another preferred embodiment, the present invention relates to a device as described hereinabove, wherein when the at least one port means is provided across the base and communicates with a chamber that is in fluid communication with the cavity, and the chamber is at least defined by a portion of the base member and at least a portion of the lid member, the first wall member forms a first rim around the upper surface of the base member and a periphery of the depression, the second wall member forms a second rim around the lower surface of the lid member, and the first rim and the second rim abut at least in part one against the other when the lid member is in the second position.

According to another preferred embodiment, the present invention relates to a device as described hereinabove, wherein when the at least one port is provided across the base and communicates with a chamber that is in fluid communication with cavity, and the chamber is at least defined by a portion of the base member and at least a portion of the lid member, the first rim and the second rim along with the base member and the lid member define walls of the chamber.

According to another preferred embodiment, the present invention relates to a device as described hereinabove, wherein the lid member is pivotally mounted on the base member.

According to another preferred embodiment, the present invention relates to a device as described hereinabove, wherein the trough member has at least a portion thereof that is pivotally mounted on the base member, said portion being provided with said at least one surface of the depression and the spout.

According to another preferred embodiment, the present invention relates to a device as described hereinabove, wherein said portion of the through pivots between two extreme positions, that is a first position where said at least one surface of the depression is substantially parallel with the upper surface of the base member, and a second position where said at least one surface of the depression is inclined to have the spout moves downwardly.

According to another preferred embodiment, the present invention relates to a device as described hereinabove, wherein the vacuum device is incorporated to the base.

According to another preferred embodiment, the present invention relates to a device as described hereinabove, wherein a filtering means is provided between said at least one port and the vacuum device.

According to another preferred embodiment, the present invention relates to a device as described hereinabove, wherein an on/off switch device is further provided and preferably mechanically connected to the base member and the lid member to remotely start/stop the vacuum device when the lid member is moved from one extreme position to another extreme position.

According to another preferred embodiment of the invention, it further comprises at least one additional port for the admission of a pressurized gas in the cavity. Said at least additional port may be provided in the base member, in the lid member or at one in the base member and the lid member. A non limitative example of the pressurized gas may consist of carbon dioxide, especially frozen carbon dioxide, dry air or mixtures thereof.

According to another preferred embodiment, the present invention relates to a method for cleaning a device as defined hereinbefore, wherein a vacuum is applied by the vacuum device to the cavity to create an air stream than entrain dust and/or particles that may be present in the cavity. Optionally, the air stream may be increased by admitting within the cavity of a pressurized gas.

BRIEF DESCRIPTION OF THE DRAWINGS

The present invention will be better understood with reference to the enclosed drawings illustrating particularly preferred and non limitative aspects of said invention. More particularly, said drawings comprise the following figures.

Figure 1:
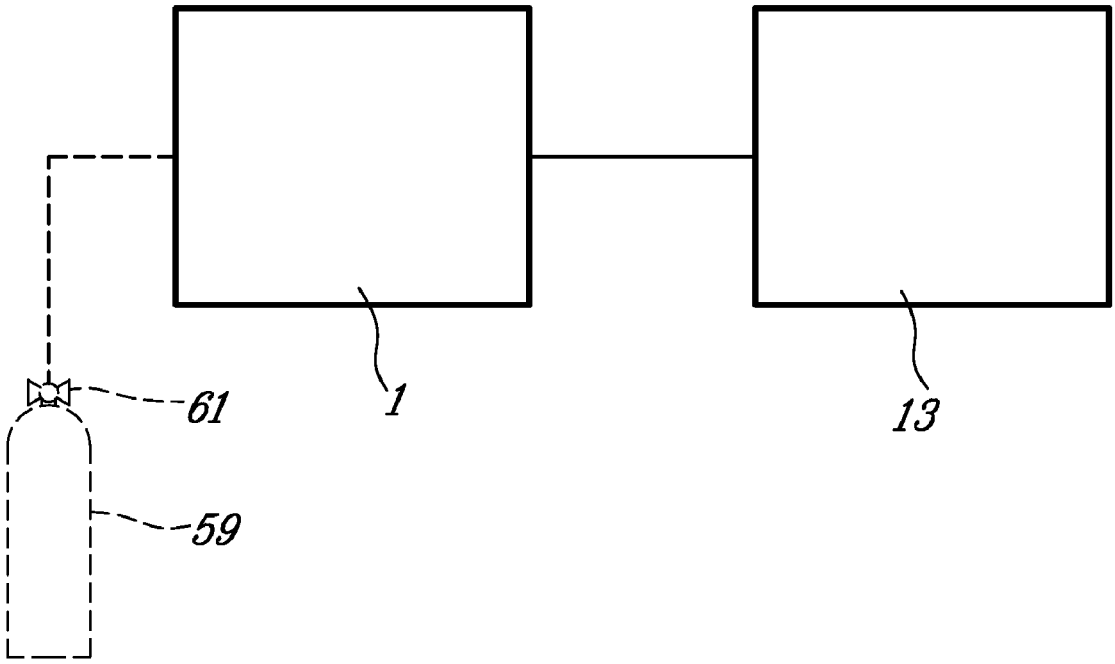
FIG. 1 is a schematic view of a pill counting device according to the invention with a vacuum device and in dotted lines a variant thereof where a pressurized gas is further used simultaneously with the vacuum device.
Figure 2:
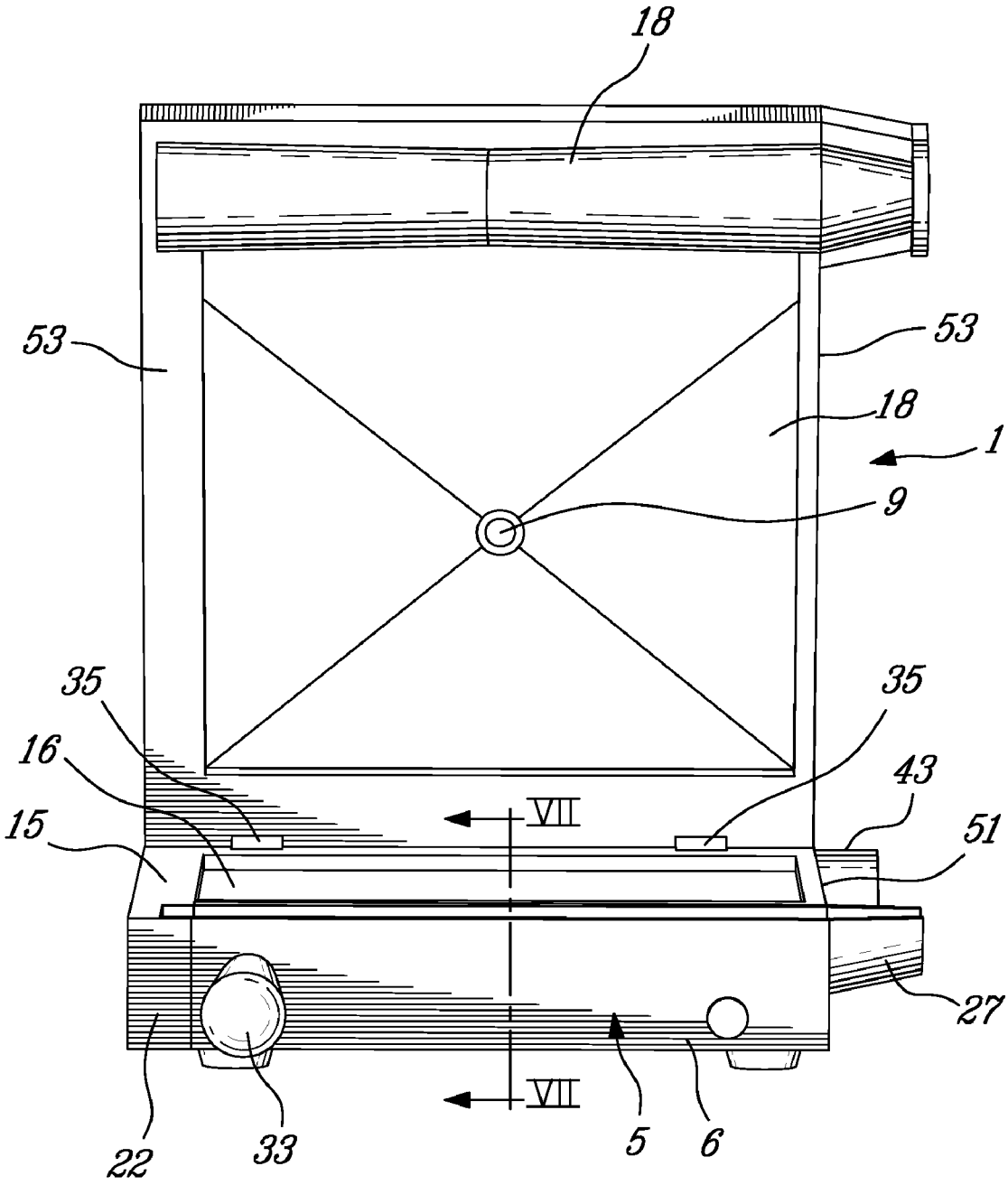
FIG. 2 is a side elevation view of a pill counting device according to a first particularly preferred embodiment invention.
Figure 3A:
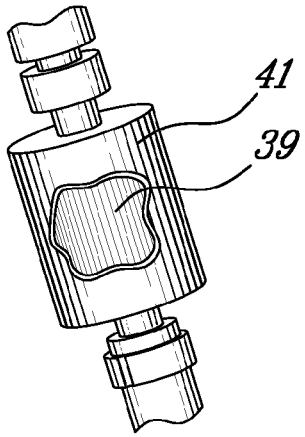
FIG. 3A is an illustration of a filter in a cartridge shown in FIG. 3B.
Figure 3B:
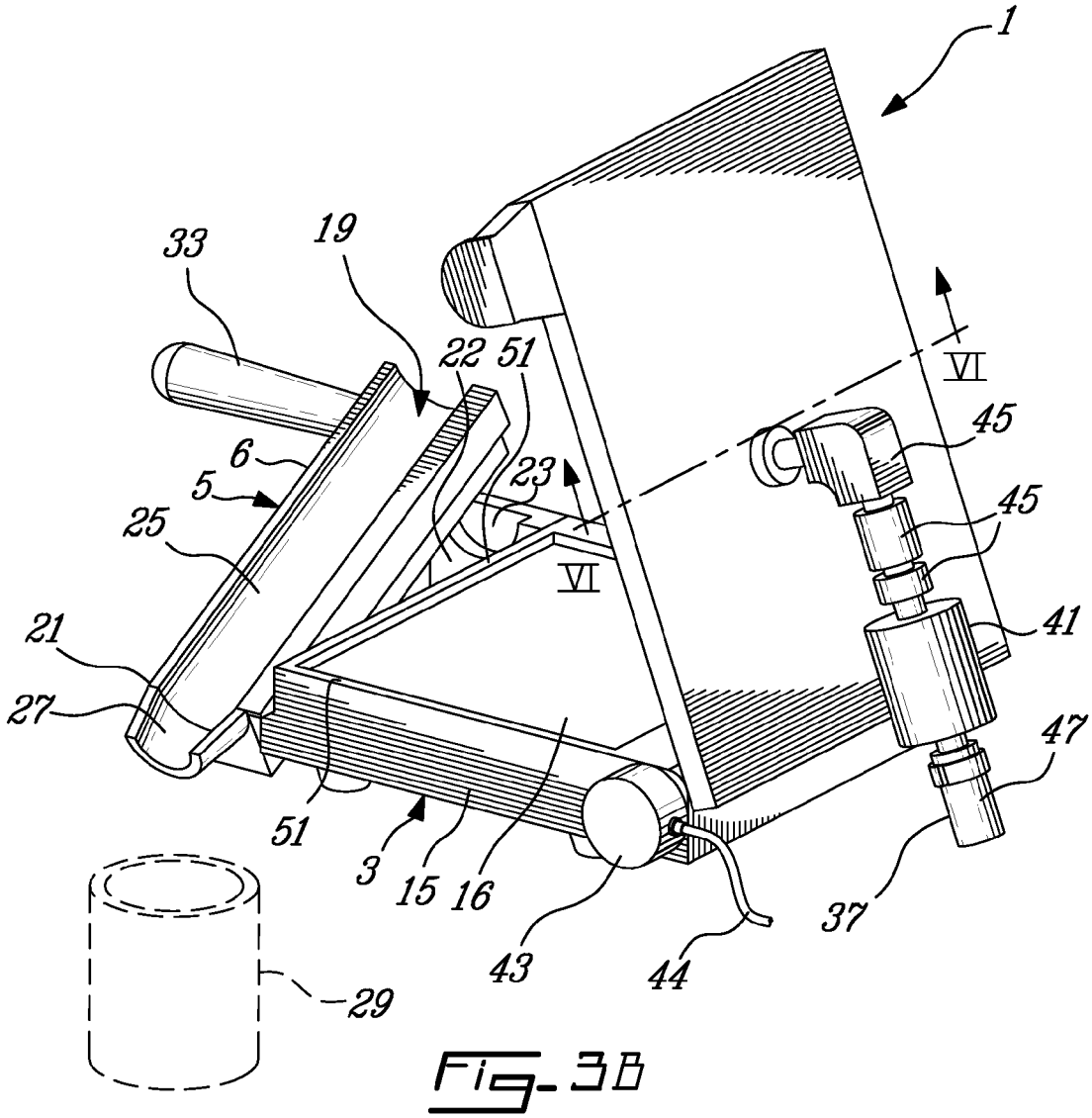
FIG. 3B is a perspective view of the pill counting device of FIG. 2 (with the trough inclined).
Figure 4:
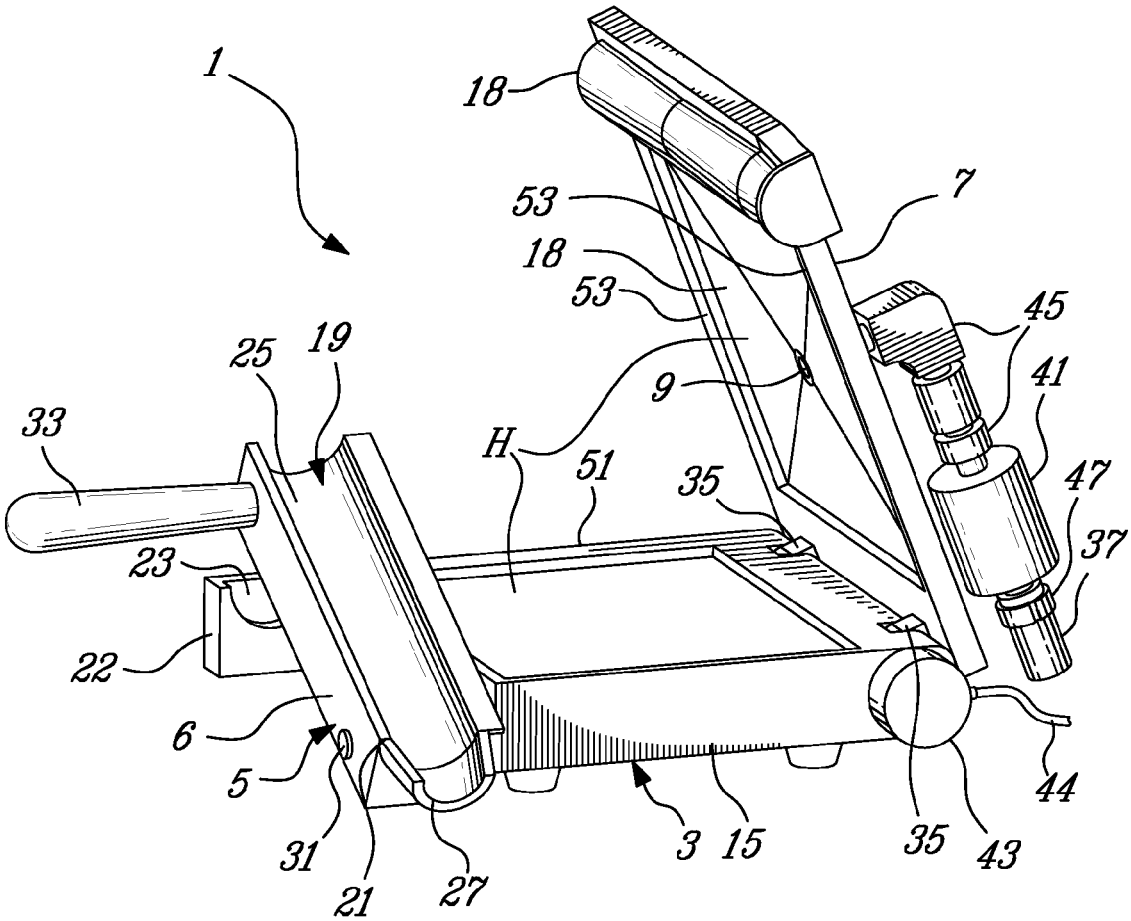
FIG. 4 is a perspective view of the pill counting device of FIG. 3B.
Figure 5:
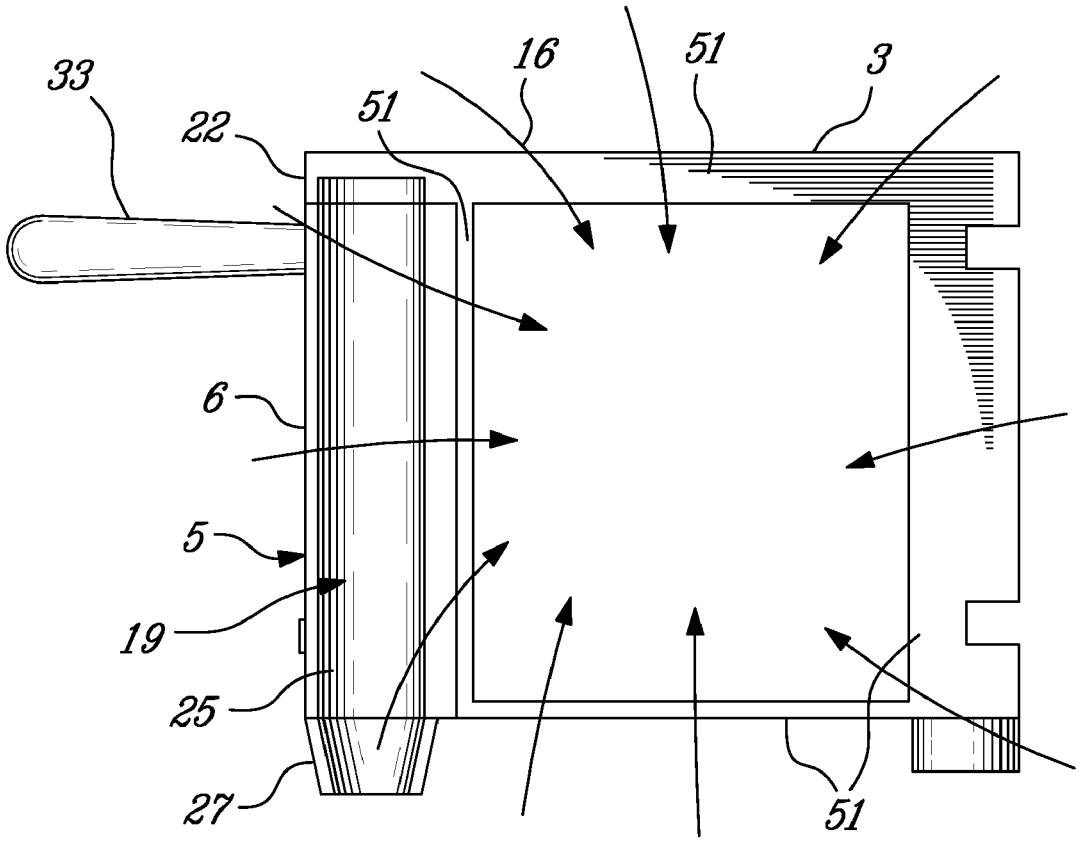
FIG. 5 is a top plane view of the base member and trough member.
Figure 6:
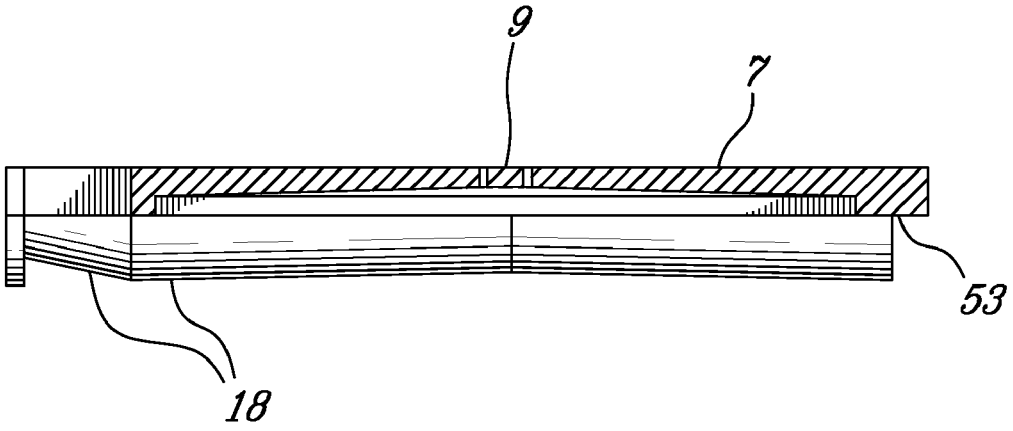
FIG. 6 is a cross sectional view of the portion of the lid according to line VI-VI in FIG. 3.

DESCRIPTION OF BEST MODES FOR CARRYING OUT PARTICULARLY PREFERRED EMBODIMENTS OF THE INVENTION

According to a first particularly preferred embodiment of the invention, there is described with reference to FIGS. 1 to 7 of the drawings, a self cleaning pill counting device 1. This device 1 comprises in combination a tray 3, a trough member 5, a lid member 7 and at least one port such as an opening 9 as illustrated, provided in the lid member 7 and adapted to be connected in fluid communication with a cavity 11 and with an air intake of a vacuum device 13 that is remotely controlled. When the lid member 7 is in closed position (i.e. at second position) and a vacuum is applied to said at least one port 9, an air stream is established in the cavity 11 to entrain toward the vacuum device 13 dusts and/or particles that may be present in the cavity 11.

More particularly, the tray 3 comprises a base member 15 having an upper surface 16 for receiving a bulk quantity of pills; a trough member 5 alongside the base member 15 and provided with a depression 19 having opposite ends 21, 23 and at least one surface 25 for receiving a load of a counted quantity of pills from said bulk quantity. The end 21 further defines a spout 27 for the unloading said counted quantity of pills in a pills container 29 (shown in dotted lines in FIG. 3). The trough member 5 has a portion 6 that is pivotally mounted to the base member 15 on a pivot 31 and is optionally provided, as illustrated, with a handle 33. A remaining portion 22 of the trough member 5 makes an integral part of the base member 15 and comprises the end 23.

The trough member 5 can be moved between two extreme positions, that is: a first position (see FIG. 2) where the lid member 7 is away from the upper surface 16 of the base member 15 and the surface 25 of the depression 19 of the trough member 5; and a second position (see FIG. 4) where a lower surface 18 of the lid member 7 is close and above the upper surface 16 of the base member 15 and the surface 25 of the depression 19 of the trough member 5 to thereby create a cavity 11.

The lid member 7 has a lower surface 18 and is mounted on the base member 15 around hinges 35 to be movable between two extreme positions, that is: a first position where the lower surface 18 of the lid member 7 is away from the upper surface 16 of the base member 15 and the surface 25 of the depression 19 of the trough member 5; and a second position where the lower surface 18 of the lid member 7 is close and above the upper surface 16 of the base member 15 and the surface 25 of the depression 19 of the trough member 5 to thereby create a cavity 11. When the lid member 7 is in the second position and a vacuum is applied to said opening 9, an air stream is established in the cavity 11 (see arrows) to entrain toward the vacuum device 13 dusts and/or particles that may be present in the cavity 11.

Also, even though any appropriate means can be used to connect the at least one port with an inlet port of the vacuum device, preferably the opening 9, as illustrated in FIGS. 1 to 7, is connected to an inlet port of the vacuum device 13 with a vacuum hose 37. This vacuum device may be of any common type. Preferably, the vacuum device is operated by an electric motor. Also, preferably as illustrated, a filter 39 is advantageously provided across the hose 37 for collecting air borne particle that are entrained form the cavity 11. The filter 39 may advantageously consists of a cartridge 41 that is mounted across the hose 37. The mounting of said cartridge can be made by any appropriate means, preferably conventional connectors. Similarly, the connection of the hose 37 to the opening 9 and the air intake of the vacuum device 13 can be made by any appropriate means, preferably with conventional connectors. Said connectors can be made of any appropriated materials, such as plastic or metal tubing As illustrated in FIGS. 1 to 7, the vacuum device 13 is remotely operated by a on/off rotary switch 43 mounted at the hinge portion of a base member 14 and lid member 7. When the lid member 7 is in the first position (i.e. away from the base member 15), the switch 43 is <<off>> and stops the vacuum device 13. When the lid member 7 is in the second position, the switch 43 is <<on<< and starts the vacuum device 13. As illustrated, the switch 43 and the electric motor of the vacuum device may be connected with an electric cord 44. Of course this electric cord is only illustrative and can be replace by any appropriate means well known to skilled workman. Alternatively, the on/off rotary switch 43 may be replaced and/or combined with a timer device in order to run the vacuum device for a determined period of time, or with any other appropriate device well known to skilled workman to control the operation of a vacuum device.

The cavity 11 which is positioned between the lower surface 18, which is preferably shaped as a funnel toward the opening 9 as illustrated, the surface 25 and the upper surface 16, and has its height adjusted with the capacity of the vacuum device 13. Preferably, as illustrated, the cavity is further delimited by rims 51 and 53. Said rims abut one against the other to fix the height of the cavity 11. This height may preferably vary from few millimeters to few centimeters. When the vacuum device 13 has a low capacity, the height will be smaller and when the vacuum device 13 has a high capacity the height will be greater. It is just necessary to create a stream of air within said cavity 11 to entrain dusts and/or particles that may be present in said cavity 11 toward the vacuum device 13 and preferably, as illustrated against the filter 39 where dusts and/or particles are collected. Of course this filter 39 may be easily detachable from the vacuum hose 37 and can be replaced easily. As illustrated, fittings 45, 47 can be provided. Of course, any other appropriate means allowing to easily remove filter 39 can be used. The used filters 39 can be discarded in bio-hazardous waste.

Material use to embody the device according to the invention may be of any kind. Preferably, metal or plastic material can be used. An example of metal can be aluminum of stainless steel while an example of plastic material may be polyethylene, etc.

In order to use a device 1 as defined hereinabove, the lid member 7 is moved away from the base member 15, the rotary switch is moved to a off position to stop the vacuum device if it was still running, and a bulk amount of pills in poured from a bulk container on the upper surface 16 of the base member 15, and then pills are manually counted and drop in the depression 19 as with conventional pill trays. Then the portion 6 of the trough member 5 is pivoted around its pivot 31 to pour the counted quantity in the pill container 29. Thereafter, the remainder of the bulk amount of pills are removed from the upper surface and returned in the bulk container.

Optionally, as illustrated in FIG. 1, the self cleaning device 1 may be further provide with at least one admission port (preferably one or several openings) connected to a source of a pressurized gas in the cavity. More particularly, said admission port(s) (preferably opening(s)) may comprise nozzles to create and direct one or several air jets against one or several surfaces delimiting the cavity 11. Said admission port may be provided in the lid member 7 and/or in the base member 15.

The pressurized gas may consist of carbon dioxide, dry air or mixtures thereof. The pressurized gas may be obtained from a pressurized container 59 (as illustrated in FIG. 1), a compressor or any other source of pressurized gas. Advantageously, said at least one admission port for the pressurized gas and said at least one port for the vacuum are at opposite ends of the cavity.

Advantageously, as illustrated in dotted lines in FIG. 1, the source of pressurized gas may be connected to said at least one admission port with conventional tubings and fittings well known to skilled workman. The control of the pressurized gas may be obtained with valves 61 also well known to skilled workman. Alternatively, this valve may be controlled by a solenoid optionally activated by the rotary switch 43.

Thereafter, the lid member 7 is moved toward its second position around the hinges, the rotary switch is moved to a on position to activate a vacuum device that will create a vacuum in cavity 11 to entrain dusts and/or particles toward the filter 39.

Thereafter, generally after a determined period of time, the lid member 7 is moved away from the upper surface 16 and surface 25, the rotary switch is returned to the off position to stops the vacuum device and the device 1 can be used again. If necessary, a visual check of the surfaces, the above operation can be repeated if there is still some traces of dusts and/or particles.

Figure 7:
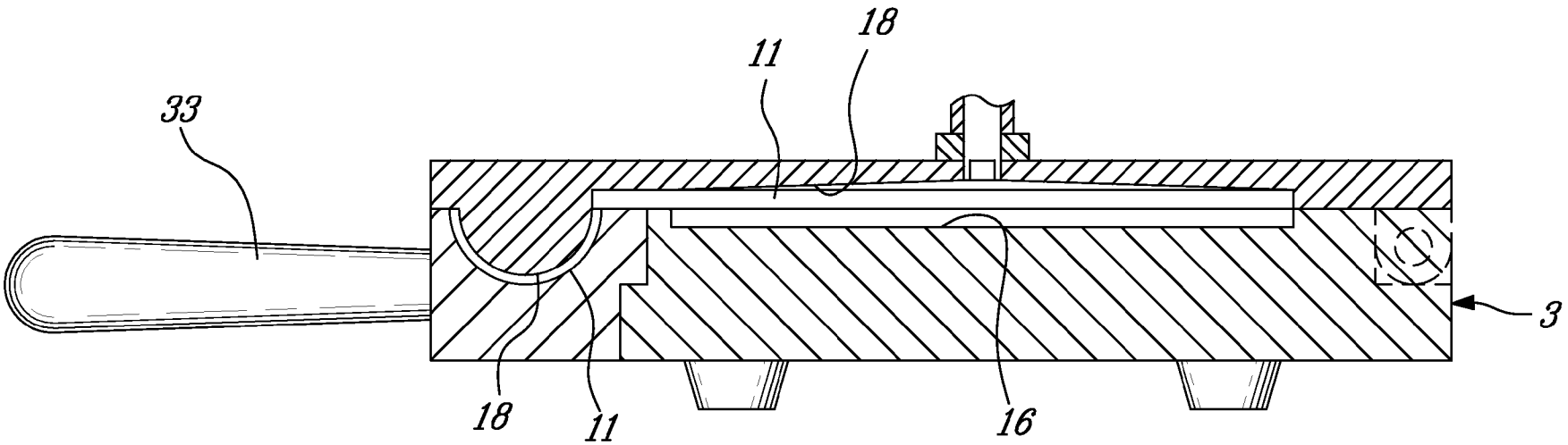
FIG. 7 is cross sectional view according to line VII-VII in FIG. 2 with the lid member in close position.
Figure 8:
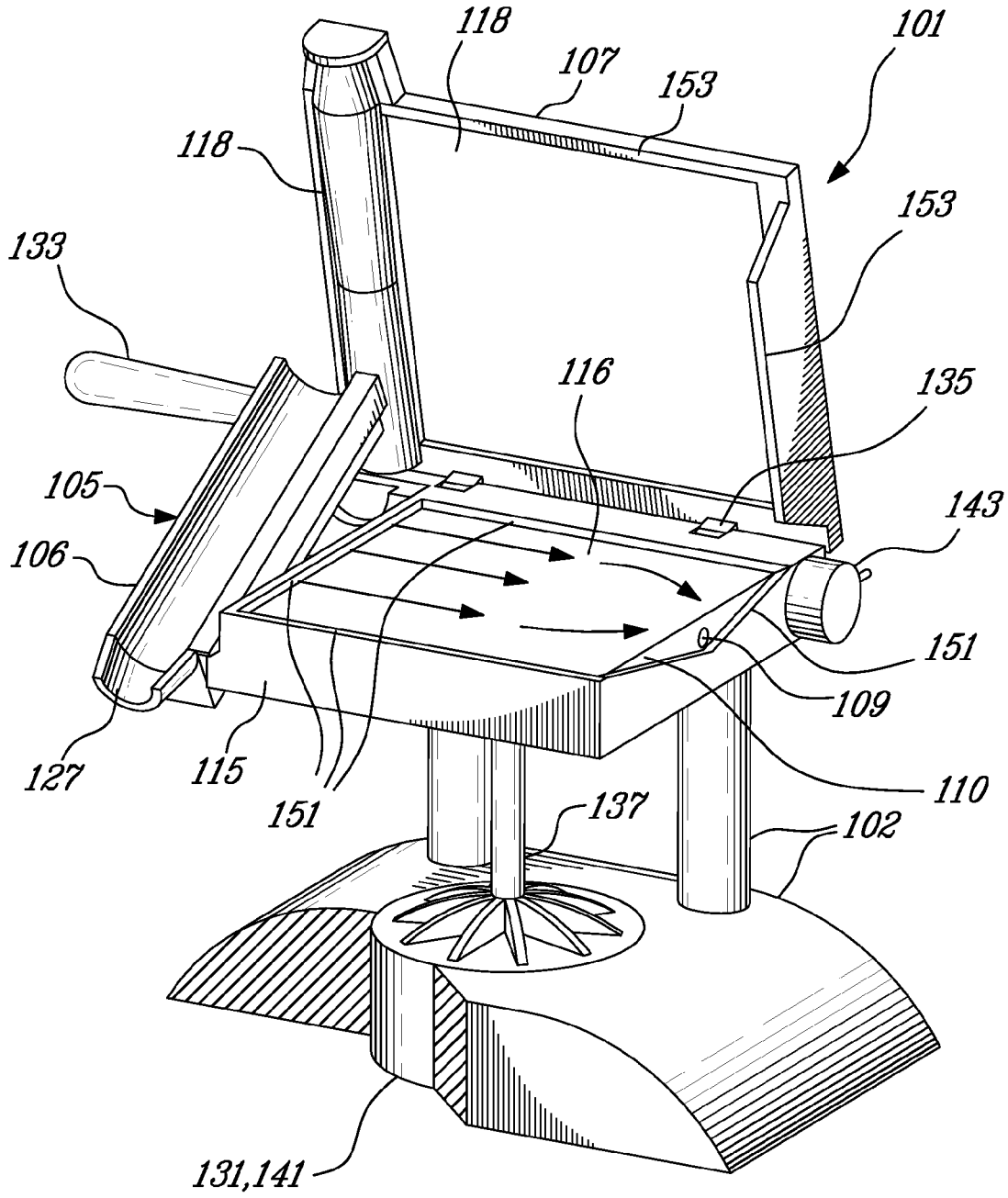
FIG. 8 is a perspective view of a pill counting device according to a second particularly preferred embodiment invention.
Figure 9:
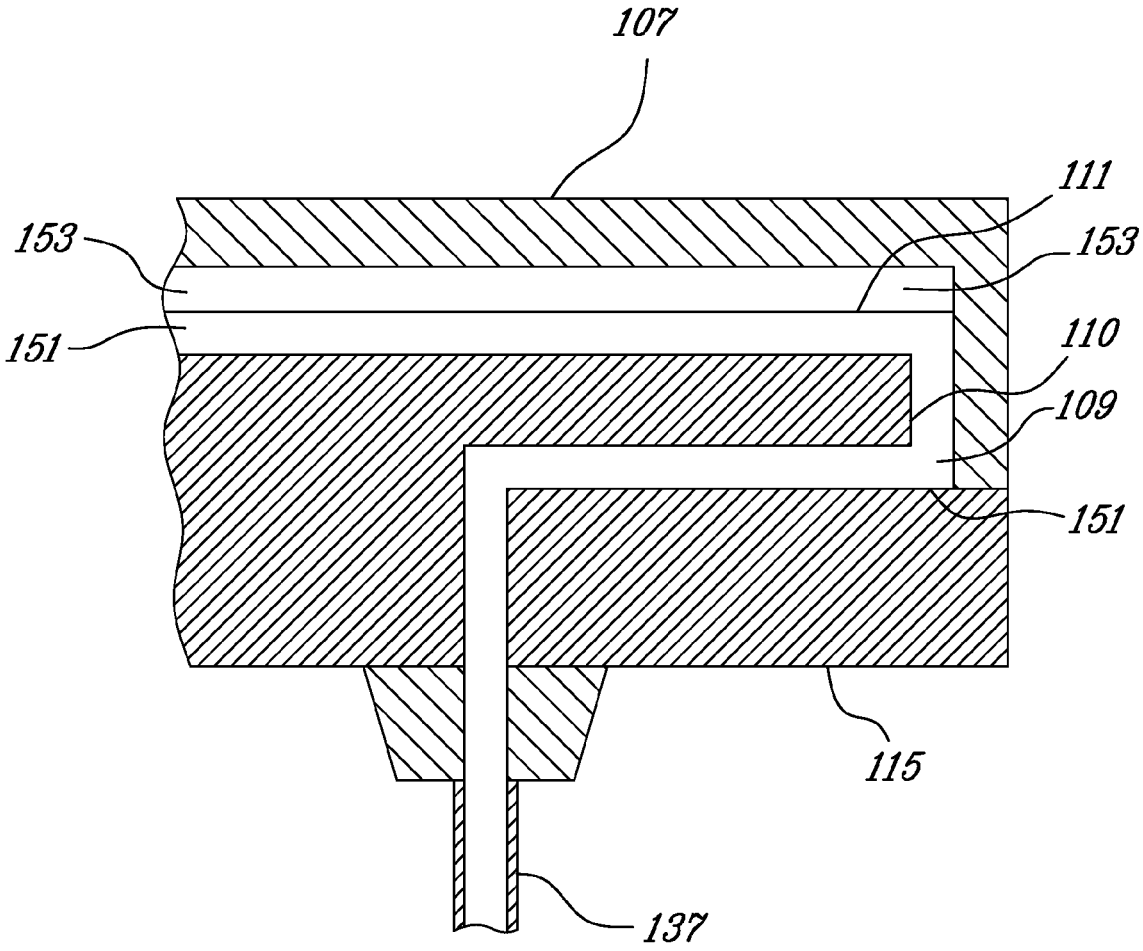
FIG. 9 is a partial cross sectional view of the pill counting device of FIG. 8 showing details of the chamber.

As illustrated in FIGS. 7 and 8 of the drawings, the self cleaning pill counting device 101 is similar to the device 1 except that the at least one port is defined by the opening 109, is provided across the base member 15 and communicates with a chamber 110 that is in fluid communication with the cavity 111. The chamber 110 is defined is defined by a portion of the base member 115 and a portion of the lid member 117. Also, the device 101 has the vacuum device 131 and/or the filter 141 integrated in a pedestal 102 supporting the device 101. When only the filter 141 is incorporated in the pedestal, the vacuum device 131 may be connected to the filter with conventional tubings and fittings. Remaining parts of the device 101 are similar to those of device 1 and operation of said device 101 is similar except for the flow of the air stream (see arrows). Similar parts of the device 1 are merely incremented by 100 in the device 101.

While the invention has been described in connection with specific embodiments thereof, it will be understood that it is capable of further modifications and this application is intended to cover any variations, uses, or adaptations of the invention following, in general, the principles of the invention and including such departures from the present disclosures as come within known or customary practice within the art to which the invention pertains and as may be applied to the essential features herein before set forth, and as follows in the scope of the appended claims.

The invention claimed is:

1. A self cleaning pill counting device comprising in combination:

a tray comprising:

a base member having an upper surface for receiving a bulk quantity of pills;

a trough member alongside the base member and provided with a depression having opposite ends and at least one surface for receiving a load of a counted quantity of pills from said bulk quantity, one of said opposite ends further defining a spout for the unloading said counted quantity of pills in a pills container, a lid member having a lower surface, the lid member being mounted on the base member and being movable between two extreme positions, that is:

a first position where the lower surface of the lid member is away from the upper surface of the base member and the surface of the depression of the trough member;

a second position where the lower surface of the lid member is close and above the upper surface of the base member and the surface of the depression of the trough member to thereby create a cavity;

at least one port provided in the tray and/or in the lid member and adapted to be connected in fluid communication with the cavity and with an air intake of a vacuum device that is remotely controlled;

being understood that when the lid member is in the second position and a vacuum is applied to the at least one port, an air stream is established within the cavity to entrain toward the vacuum device dusts and/or particles that may be present in the cavity.

2. A device according to claim 1, wherein the lower surface of the lid member is substantially mating above the upper surface of the base and the surface of the depression of the trough member.

3. A device according to claim 1, wherein the at least one port is one opening provided across the lid member and communicates with the cavity through the lower surface.

4. A device according to claim 3, wherein at least a portion of the lower surface of the lid member defines a funnel of small height toward the opening.

5. A device according to claim 1, wherein at least a portion of a periphery of the upper surface is adjacent a first wall member, at least a portion of a periphery of the lower surface is adjacent a second wall member, and the first wall member and the second wall member abut at least in part one against the other when the lid member is in the second position.

6. A device according to claim 5, wherein the first wall member forms a first rim around the upper surface of the base member and a periphery of the depression, the second wall member forms a second rim around the lower surface of the lid member, and the first rim and the second rim abut at least in part one against the other when the lid member is in the second position.

7. A device according to claim 3, wherein the lid member is pivotally mounted on the base member.

8. A device according to claim 3, wherein the trough member has at least a portion thereof that is pivotally mounted on the base member, said portion being provided with said at least one surface of the depression and the spout.

9. A device according to claim 8, wherein said portion of the trough can pivot between two extreme positions, that is a first position where said at least one surface of the depression is substantially parallel with the upper surface of the base member, and a second position where said at least one surface of the depression is inclined to have the spout move downwardly.

10. A device according to claim 1, wherein the at least one port is provided across the base and communicates with a chamber that is in fluid communication with the cavity, the chamber being at least defined by a portion of the base member and at least a portion of the lid member.

11. A device according to claim 10, wherein at least a portion of a periphery of the upper surface comprises a first wall member, at least a portion of a periphery of the lower surface comprises a second wall member, and the first wall member and the second wall member abut at least in part one against the other when the lid member is in the second position.

12. A device according to claim 11, wherein the first wall member forms a first rim around the upper surface of the base member and a periphery of the depression, the second wall member forms a second rim around the lower surface of the lid member, and the first rim and the second rim abut at least in part one against the other when the lid member is in the second position.

13. A device according to claim 12, wherein the first rim and the second rim along with the base member and the lid member define walls of the chamber.

14. A device according to claim 10, wherein the at least one port is one opening.

15. A device according to claim 10, wherein the lid member is pivotally mounted on the base member.

16. A device according to claim 10, wherein the trough member has at least a portion thereof that is pivotally mounted on the base member, said portion being provided with said at least one surface of the depression and the spout.

17. A device according to claim 16, wherein said portion of the trough pivots between two extreme positions, that is a first position where said at least one surface of the depression is substantially parallel with the upper surface of the base member, and a second position where said at least one surface of the depression is inclined to have the spout move downwardly.

18. A device according to claim 10, wherein the vacuum device is incorporated to the base.

19. A device according to claim 1, wherein a filtering means is further provided between said at least one port and the vacuum device.

20. A device according to claim 1, wherein an on/off switch is further provided to remotely start/stop the vacuum device.

21. A device according to claim 1, wherein it further comprises at least one admission port for introducing a pressurized inert gas in the cavity.

22. A device according to claim 21, wherein said admission port is further provided with a nozzle to create an air jet oriented toward one of the surfaces delimiting the cavity.

23. A device according to claim 21, wherein the pressurized inert gas is selected from the group consisting of carbon dioxide, dry air and a mixture thereof.

24. A method for cleaning a device as defined in claim 1, wherein a vacuum is applied by the vacuum device to create an air stream in the cavity that entrains particles that may be present in said cavity.

25. A method according to claim 24, wherein simultaneously with the vacuum applied by the vacuum device, a pressurized gas is introduced in the cavity through said at least one port provided in the lid member or in the base member and communicating with the cavity.

26. A method according to claim 24, wherein said at least one port is further provided with a nozzle to create an air jet oriented toward one of the surfaces delimiting the cavity.

* * * * *